US005460339A

United States Patent [19]

Drew

[11] Patent Number: 5,460,339

[45] Date of Patent: Oct. 24, 1995

[54] LOCKING WINDING SHAFT

[76] Inventor: Julius Drew, 365 French Street, Oshawa, Ontario, Canada, L1G 5N6

[21] Appl. No.: 156,362

[22] Filed: Nov. 23, 1993

[51] Int. Cl.[6] ..... B65H 18/04; B65H 75/24

[52] U.S. Cl. ..... 242/572; 242/530.3

[58] Field of Search ..... 242/56.9, 72.1, 242/530.3, 572, 573, 573.2, 573.7, 573.9

[56] References Cited

U.S. PATENT DOCUMENTS 4,307,851 12/1981 Dunaevsky et al. ..... 242/530.3

4,461,430 7/1984 Lever ..... 242/530.3

5,279,470 1/1994 Birkmann et al. ..... 242/530.3

*Primary Examiner*—John P. Darling

*Attorney, Agent, or Firm*—Fay, Sharpe, Beall, Fagan, Minnich & McKee

[57] ABSTRACT

A locking shaft is provided for winding of elongated materials around a drum core. The winding core is provided with an clamp which is able to expand or contract the effective diameter of the shaft so as to engage a drum core thereto during winding.

7 Claims, 4 Drawing Sheets

1
2
9
10
11
12
13
14
15
16
20
21
30
31

LOCKING WINDING SHAFT

The present invention relates to a shaft for releasably engaging or locking a ring drum core thereto for winding an elongated member about the core; the elongated member may, for example, be thread, yarn, ribbon, wife, cord, band and the like.

The present invention generally provides a winding shaft for winding an elongated member about a ring drum core, said shaft being configured for role usably engaging said ring drum core, said ring drum core having an inner diameter, said winding shaft comprising clamp means having an expanded configuration and a contracted configuration, and means for urging the clamp means between said expanded and contracted configurations, said clamp means being configured such that when the damp means is in an expanded configuration and a ring drum core is disposed about the shaft, the shaft has an outer diameter greater than the inner diameter of the ring drum core, the clamp means engaging the ring drum core such that rotation of the shaft rotates the ring drum core for winding an elongated member about said ring core and when the clamp means is in a contracted configuration and a ring drum core is disposed about the shaft, the shaft has a diameter smaller than the inner diameter of the ring drum core and the ring drum core is removeable from the shaft.

The present invention in one aspect provides a winding shaft for winding an elongated member about a ring drum core, said shaft being configured for releasably engaging said ring drum core, said ring drum core having an inner diameter, said winding shaft comprising a hollow outer casing member, and expansion clamp means for releasably engaging said ring drum core, said outer casing member being provided with an opening, said outer casing member having an outer diameter smaller than the inner diameter of said ring drum core, said expansion clamp comprising a deformable stem member projecting from a support member, said support member being disposed within said hollow casing member and being displaceable between an operative and a non-operative position, and means for displacing the support between said operative and non-operative position, said stem member and said opening being sized and configured such that when said ring drum core is disposed about the outer casing member over said opening and said support member is in an operative position, the stem member is in an extended configuration wherein an end part of the stem member extends out of said opening such that the stem member engages the ring drum core such that rotation of the shaft rotates the ring drum core for winding an elongated member about said ring drum core and when said ring drum core is disposed about the outer casing member over said opening and said support is in a non-operative position, the stem member is deformed such that the stem member is in a retracted configuration wherein said end part of the stem member is retracted relative to said opening such that the shaft has an outer diameter smaller than the inner diameter of the ring drum core and the ring drum core is removable from the shaft.

In accordance with the present invention, a winding shaft may be configured for releasably engaging a plurality of said ring drum cores wherein said outer casing member is provided with a plurality of pairs of opposed openings, said pairs of openings being axially spaced apart from each other, and wherein said expansion clamp means comprises a plurality of pairs of opposed stem members, said pairs of stem members being axially spaced apart from each other, each pair of stem members and a respective pair of said openings being sized and configured such that when a respective ring drum core is disposed about the outer casing member over said respective pair of openings and the support member is in said operative position, each stem member of said pair of stem members is in an extended configuration wherein an end part thereof extends out of said respective opening such that each stem member of said pair of stem members engages said respective ring drum core such that rotation of the shaft rotates said respective ring drum core for winding an elongated member about said ring core, and when said respective ring drum core is disposed about the outer casing member over said respective pair of openings and the support means is in a non-operative position, each stem member of said pair of stem members is deformed such that each stem member of said pair of stem members is in a retracted configuration wherein said end part of said stem member is retracted relative to said respective opening such that the shaft has an outer diameter smaller than the inner diameter of the ring drum core and the ring drum core is removable from the shaft.

In accordance with another aspect, the present invention provides a winding shaft able to releasably engage a plurality of ring drum cores such that an elongated member may be wound about each of said ring drum cores, each of said ring drum cores having an inner diameter, said winding shaft comprising a hollow outer casing member, and expansion clamp means for releasably engaging said ring drum cores, said hollow outer casing member having an outer diameter smaller than the inner diameter of said ring drum cores, said hollow outer casing member being provided with a plurality of pairs of opposed openings, said pairs of openings being axially spaced apart from each other, said expansion clamp comprising a plurality of pairs of opposed stem members projecting from a support member, said pairs of stem members being axially spaced apart from each other, said support member being disposed within said hollow casing member and being displaceable between an operative and a non-operative position, and means for displacing the support between said operative and non-operative position, each pair of stem members and a respective pair of said openings being sized and configured such that when a respective ring drum core is disposed about the outer casing member over said respective pair of openings and the support member is in said operative position, each stem member of said pair of stem members is in an extended configuration wherein an end part thereof extends out of a said respective opening such that each stem member of said pair of stem members engages said respective ring drum core such that rotation of the shaft rotates said respective ring drum core for winding an elongated member about said ring drum core, and when said respective ring drum core is disposed about the outer casing member over said respective pair of openings and the support means is in a non-operative position, each stem member of said pair of stem members is in a retracted configuration wherein said end part of said stem member is retracted relative to said respective opening such that the shaft has an outer diameter smaller than the inner diameter of the ring drum core and the ring drum core is removable from the shaft. In accordance with the present invention, a winding shaft may have a hollow casing member which has an interior wall and the support member may be sized and configured to engage the interior wall of the hollow casing for sliding displacement of the support member between said operative and non-operative positions.

In accordance with a further aspect, the present invention in particular provides a winding shaft for winding an elongated member about a ring drum core, said shaft being configured for releasably engaging said ring drum core, said ring drum core having an inner diameter, said winding shaft comprising clamp means having an expanded configuration and a contracted configuration, and means for urging the clamp means between said expanded and contracted configurations, said clamp means being configured such that when the clamp means is in an expanded configuration and a ring drum core is disposed about the shaft, the clamp means engages the ring drum core such that rotation of the shaft rotates the ring drum core for winding an elongated member about said ring drum core and when the clamp means is in a contracted configuration and a ring drum core is disposed about the shaft, the shaft has a diameter smaller than the inner diameter of the ring drum core and the ring drum core is removable from the shaft said hollow casing member having an interior wall and said support member being sized and configured to engage the interior wall of the hollow casing for sliding displacement of the support member between said operative and non-operative positions.

In accordance with the present invention, a winding shaft as herein described may include locking means for releasably locking the support means in said operative position.

A stem member in accordance with the present invention may, for example, be of any suitable flexible material such as for example of nylon, polyurethane and the like; suitable polyurethane (round) rod material is made by Fennermanheim Germany.

A winding shaft in accordance with the present invention may especially lend itself to the automation of the installation and removal of ring drum cores for winding purposes.

In the drawings which example embodiments of the present invention:

Figures 3, 4, 5:
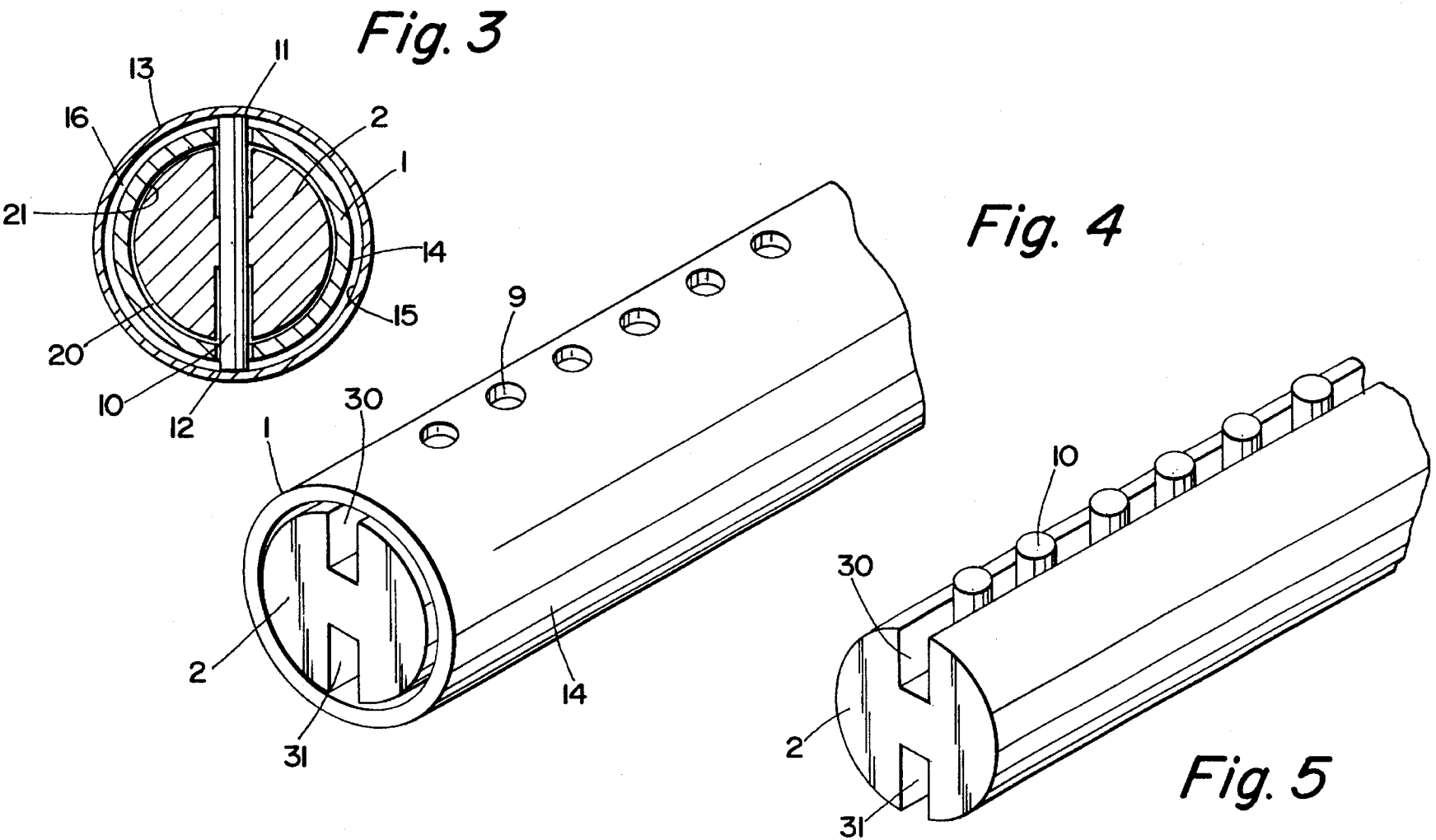
FIG. 3 shows a section along 3—3 of FIG. 1.
FIG. 4 shows a partial cut away perspective view of the outer easing member and the sliding member of the shaft of FIG. 1 but prior to insertion or installation of the opposed stem members.
FIG. 5 shows a partial cut away perspective view of the sliding member of the FIG. 1 with the stem members installed.

Turning to FIGS. 1 to 5, the winding shaft has a hollow outer casing 1 and an inner support sliding member 2. The sliding member 2 as shown in FIGS. 3, 4 and 5 has a somewhat "H" like cross section, the sides of which are rounded.

The hollow outer casing 1 is blocked off at one end by an end member 3 which is integral with the easing 1. A bias spring 4 is disposed between the end member 3 and the sliding member 2.

The hollow outer casing is releasably blocked off at the other end by cam elements 5 and 6. The cam elements 5 and 6 are held in place by respective set screws 7 and 8. The set screws are screwed into openings in respective cam elements through respective openings in the outer casing 1; the set screws are screwed in place to a depth such that they do not pass completely through the openings in the casing 1.

FIG. 4 shows a series of axially spaced upper openings disposed in the top of the casing 1. A second series of lower openings (not shown in FIG. 4) is disposed in the bottom side of the casing 1; each upper opening 9 is disposed opposite a respective lower opening so as to define a pair of opposed openings.

Figures 1, 2:
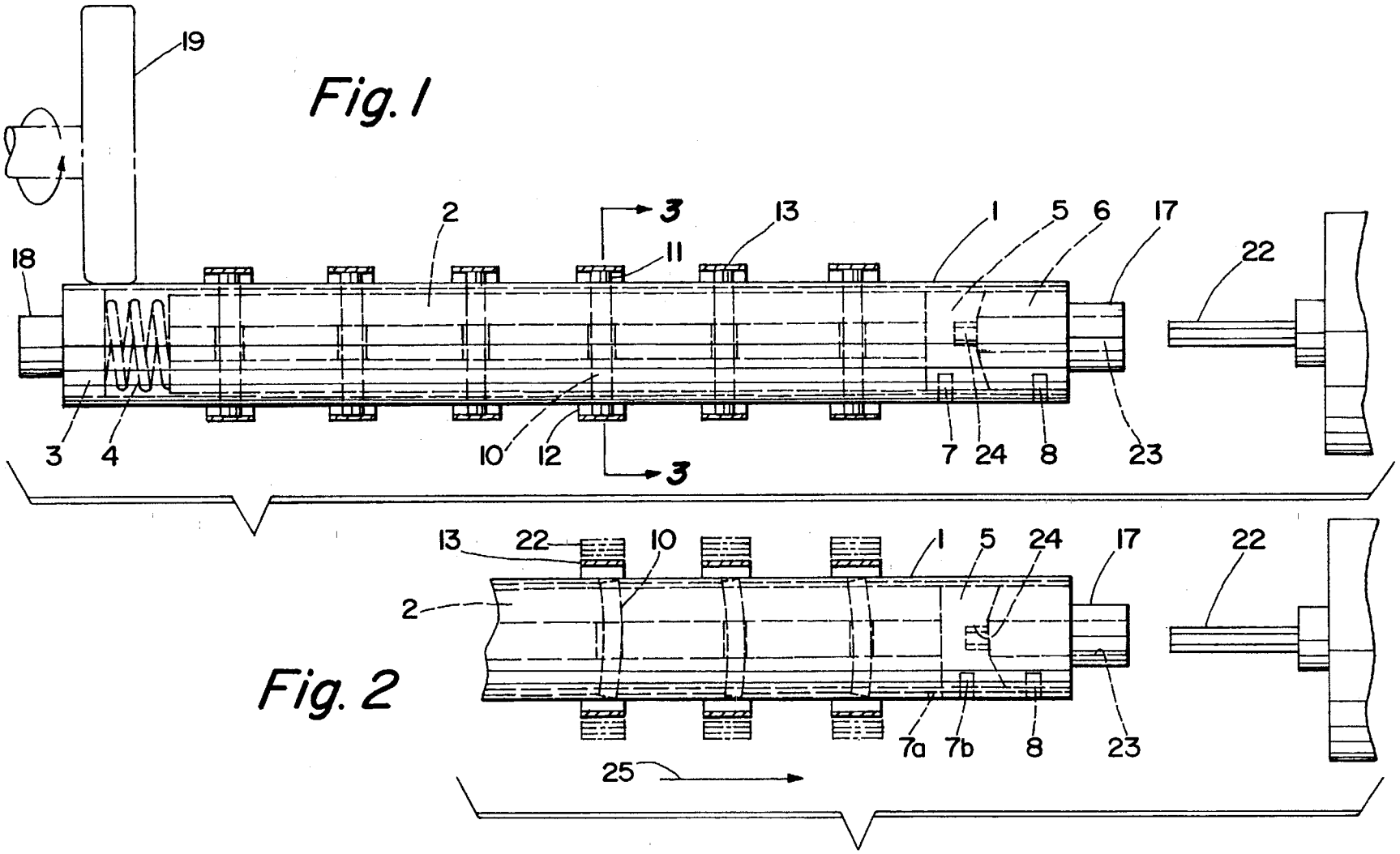
FIG. 1 is a side view of an embodiment of a winding shaft of the present invention wherein the internal structure is shown in dotted outline and cut away ring cores are shown locked in place by end parts of respective opposed stem members.
FIG. 2 is a side view of the shaft shown in FIG. 1 but wherein the support or sliding member has been displaced such that the stem members are deformed and the end parts thereof no longer engage respective ring cores.

Turning to FIGS. 1 and 3, the example embodiment of the winding shaft is shown with six stem means, one of which is designated with the reference numeral 10; although 6 stem means and attendant openings are shown the number of stem means may ms desired vary from one to any desired or convenient number. The stem means each comprise two opposed stem members which for this embodiment are integral. The sliding member 2 is in the operative position. Thus each of the stem means 10 has opposed end parts 11 and 12 which extend out of respective opposed openings in the casing 1. The stem means 10 are shown as extending from through one opposed opening in the casing 1, an opening in the sliding member 2, through the opposite opening in the casing 1. The stem means 10 are shown as more or less perpendicular to the longitudinal axis of the sliding member 2.

Still with respect to FIGS. 1 and 3, the example winding shaft is shown with ring drum cores members (one of which is designated with the reference numeral 13) held in place by respective stem means 10. Referring, in particular, to FIG. 3, as may be seen, the outer surface 14 of the casing 1 is spaced apart from the inner surface 15 of the ring core 13 by a gap 16; in other words the inner diameter of the ring core 13 is larger than the outer diameter of the casing 1.

As mentioned above, the FIGS. 1 and 3 show the sliding member 2 in an operative position. The stem means 10 have a straight vertical overall length from end part 11 to end part 12 which is longer or larger than the inner diameter of the ring cores 13. Thus, the stem means 10 each provide the shaft with respect to a respective ring core, with an effective outer diameter which is larger than the inner diameter of the ring cores 13 and act to engage or wedge the ring cores in place. The overall length of the stem means 10 preferably should not be such as to unduly deform the ring core but be sufficient so as to maintain the ring cores in place during winding of an elongated element about the ring cores 13.

As seen from FIG. 1, the winding shaft has two end axle elements 17 and 18. These axles, for winding purposes, may be rotatably engaged by any suitable supporting means. The winding shaft itself may, for example, be turned by a wheel such as wheel 19 shown in dotted outline, the wheel being powered by a motor (not shown). The elongated element (e.g. adhesive tape) to be wound onto the ring cores fixed on the winding shaft of FIG. 1 may be fed to the turning cores by any suitable known means.

Turning back to FIG. 3, the sliding member 2 has art outer surface 20 which slidably engages the inner surface 21 of the casing 1, i.e. the outer diameter of the sliding member 2 is somewhat smaller than the inner diameter of the casing 1 so as to allow for the longitudinal movement of the sliding member.

Referring to FIGS. 1 and 2, the sliding member 2 is maintained in the operative position by the cam element 5 as well as the bias spring 4; the cam element 5 is locked in place by the set screw 7.

Referring to FIG. 2, this figure shows the core members with an elongated element such as adhesive tape wound thereabout; as shown one of the adhesive windings has the reference numeral 22. In order to remove the wound cores from the winding shaft, the winding shaft is as necessary, or desired, disengaged from the support engaging the axle elements 17 and 18; the set screw 7 is then removed. An allen key 22 is passed through the axial opening 23 in the axle element 17 until it mates with the suitably configured opening 24 in the cam element 5; the opening 23 is sized larger than the allen key. The cam elements 5 and 6 are configured in any convenient manner such that turning the cam element 5 under urging of the bias spring 4 causes the sliding element 2 to be displaced longitudinally in the direction of the arrow 25 to a non-operative position as shown; the openings **7*a* and 7*b* which define the overall opening for the set screw 7 are not aligned in this position. The stem means 10 may be, for example, of a relatively flexible material such as for example nylon. Accordingly as the sliding element passes to the non-operative position shown, the stem means 10 deform such that the end parts 11 and 12 are pulled away from the cores 13 and may be retracted somewhat into the respective openings of the casing 1. This retraction, however, need only be sufficient so as to reduce the effective outer diameter of the shaft to a value smaller than that of the inner diameter of the cores 13** thereby freeing the cores for removal from the winding shaft.

With the wound cores 13 removed, new cores 13 may be disposed about the shaft over respective opposed openings in the casing 1 using means such as for example described with respect to FIGS. 10 and 11 hereinbelow. The process is then reversed with the allen key being turned in the opposite direction until the openings **7*a* and 7*b* are aligned and the set screw 7 reinserted to fix the cam element 5** in place.

A shaft as shown in FIGS. 1 to 5 may be constructed by providing a casing element open at one end and closed off by an end element at the other end; the closed off end being provided with the axle element 18. A suitable bias spring 4 is then place into the interior of the casing element. The spring is followed by a sliding member 2 having longitudinally extending upper and lower grooves 30 and 31; the end of the sliding member 2 opposite to the spring 4 is separate from the cam element 5; the cam element 5 may thus rotate without inducing rotation of the sliding member 2. In any event with the sliding member 2 and the cam element in place, the cam element 6 may be inserted into the casing and the set screw 8 put in place to block off the open end of the casing element. The allen key my then be inserted into the opening 24 in the cam element 5 and the cam element 5 may be turned until the openings **7*a* and 7*b* are aligned; the set screw 7 may then be put in place. At this point there are still no stem members 10 in place in the sliding member 2. The stem means 10 may be put in place by first verifying that each pair of opposed openings in the casing 1 are aligned with a corresponding opening connecting the grooves 30 and 31. A suitable length of (flexible) nylon shank or rod (i.e. a round rod since the openings are round) may be passed through each of the groupings of three openings, i.e. the opposed openings in the casing I and the respective opening connecting the grooves 30 and 31 (see figures 1.and 2). The outer diameter of each nylon shank or rod should be slightly larger than the inner diameter of said openings in the sliding members 2 but slightly smaller than the opposed openings in the casing 1**; for insertion purposes the nylon shank or rod may be somewhat tapered so that it may pass through all of the hole and then be pulled into place to provide a friction fit with the opening in the sliding member. With the nylon shank wedged in place it may then be cut at one or both ends so as to provide a stem member of the appropriate length in the operative position so as to engage a core and yet be deformed so as to release the core in the non-operative position.

Figure 6:
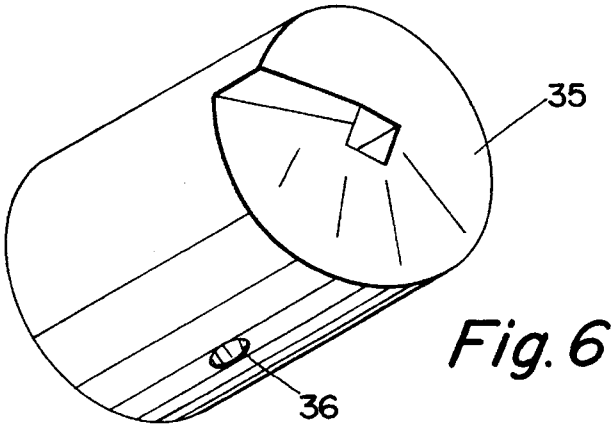
FIG. 6 shows an example cam element of a means for axially displacing the sliding member of FIG. 1 between an operative and non-operative position.
Figure 7:
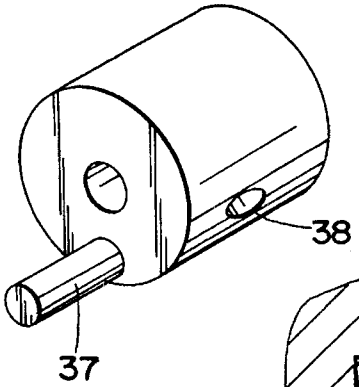
FIG. 7 shows another example cam element for co-operating with the cam element of FIG. 6 for the axial or longitudinal displacement of the sliding member of the shaft of FIG. 1.

Turning to FIGS. 6 and 7 these show example cam elements. FIG. 6 shows a possible form for cam element 5; the cam element is provided with a spiralling surface 35 and a threaded set screw opening 36. FIG. 7 shows a possible form for the cam element 6; the cam element having a projection 37 for tiding the surface 35 of the cam element of FIG. 6. The cam element of FIG. 7 is provided with a threaded set screw opening 38.

Figure 8:
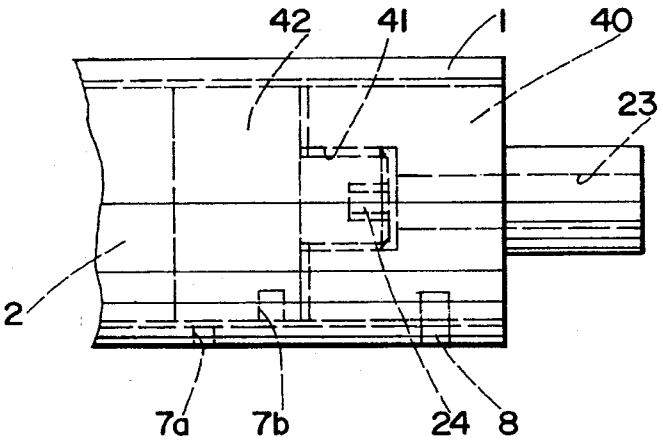
FIG. 8 shows an alternate example of a means for the axial displacement of the sliding member of FIG. 1.

FIG. 8 shows a screw based means which may be used in place of the cam element 5 and 6 mentioned above with respect to FIG. 1 to 5. The same reference numerals as used above will be used with respect to this figure to the extent that elements are common or the same. As may be seen the casing 1 is blocked off by an element 40 which has an internal thread 41 for screw engagement with the external thread of the element 42; the element 42 is separate from the sliding element 2 such that rotation of this element 42 will not rotate the sliding element 2. The sliding element 2 is shown in the non-operative position. The sliding element may be displaced to the operative position by inserting the allen key in the opening 24 and turning the element ,42 in the appropriate direction.

Figure 9:
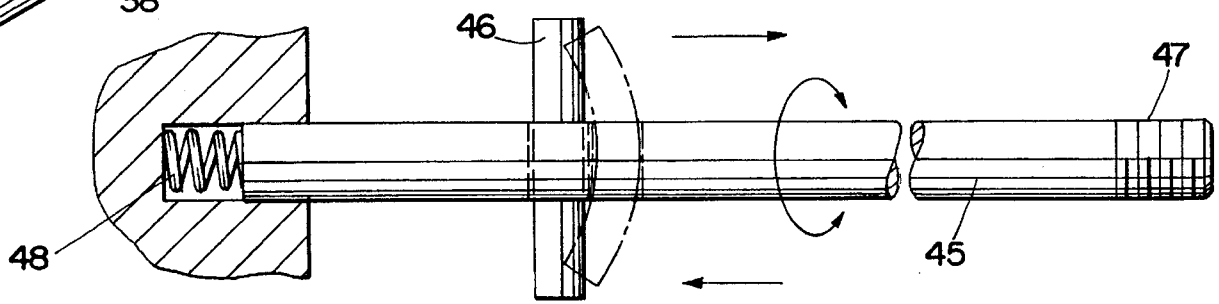
FIG. 9 shows an alternate example support means for extending and retracting example stem elements as shown in FIG. 1.

FIG. 9 shows another example of a possible support member for holding the stem means; for convenience only one stem member is shown. This embodiment comprises a shaft 45 provided with an opening for the friction fit of the stem means 46; the dotted outline 47 show the deformation of the stem. member 46 when the shaft is in a non-operative position. In this case the shaft would be significantly spaced apart from the casing wall so that there would be no sliding engagement therebetween. The shaft is provided with a threaded end 47 for engagement with a suitable screw type displacement means analogous to that as discussed above for the longitudinal displacement of the shaft 45. However, in this case the threaded element 47 is fixed to the shaft such that rotation thereof also causes a rotational movement of the shaft 45 rather than just a longitudinal shift as for the embodiment of FIG. 1 to 5. In this case deformation of the stem member is facilitated by a rotational as well as longitudinal displacement of the shaft; this embodiment also has a bias spring 48.

Figure 10:
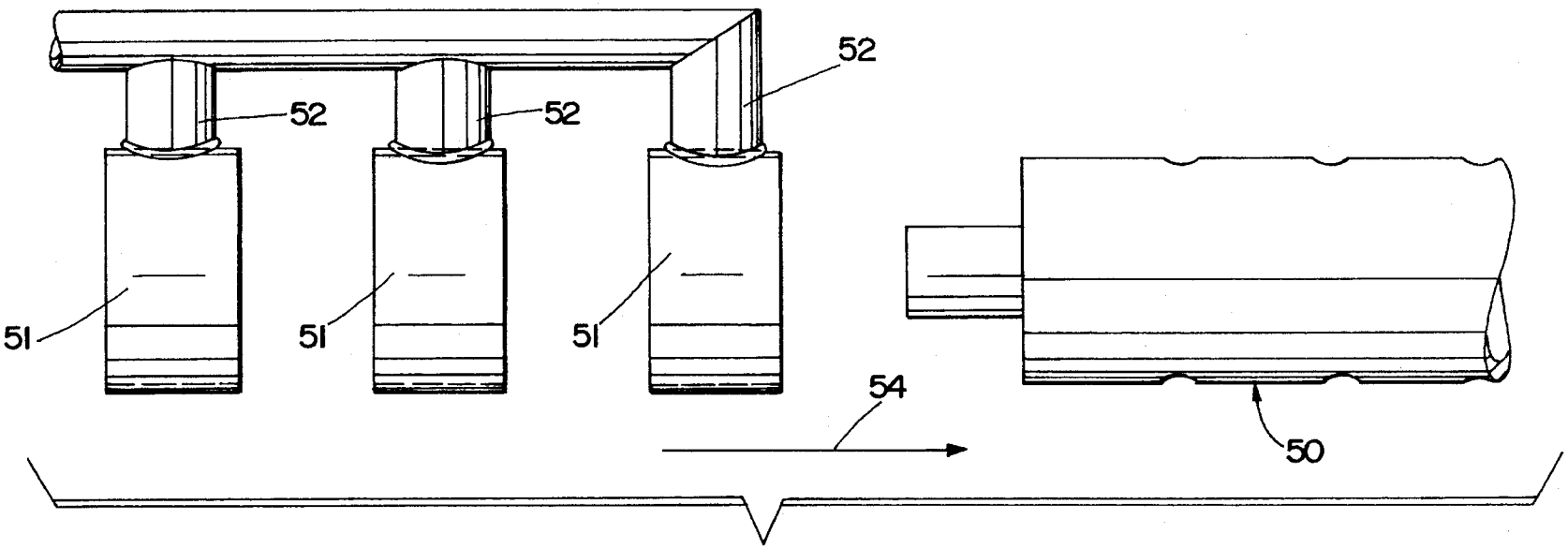
FIG. 10 shows schematically a winding shaft of the present invention being loaded with ring drum cores for winding (e.g. with adhesive tape for example) using a pneumatique or vacuum actuated jig placement means.
Figure 11:
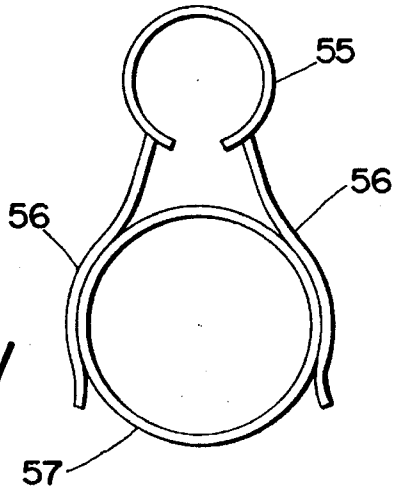
FIG. 11 shows an alternate spring clip type means for the displacement of ting drum cores to and from a shaft in accordance with the present invention.

FIGS. 10 and 11 show example means for placing and removing cores from a winding shaft in accordance with the present invention.

FIG. 10 shows a winding shaft 50 in accordance with the present invention. By way of example three ring cores 51 are shown attached to vacuum or suction members 52; the cores 51 are spaced apart the necessary distance whereby once the cores 51 are disposed on the shaft 50 by the displacement of the combination in the direction of the arrow 54. the cores will be disposed over respective pairs of openings in the outer casing. The vacuum system may be used to remove the wound cores as well.

FIG. 11 shows an alternative system to the use of suction means for the transportation of the cores, This system exploits a spring clip type arrangement. The arrangement includes a C-shape spring 55 to which is attached two opposed clip arms 56. The spring arms 56 releasably clip onto the core 57.

The above example embodiments have been discussed in relation to a stem means having at least some deformation flexibility. As an alternative the opposed stem members may each consist of two rigid stem pans or elements which are each spring biased appropriately such that the normal or home position of a stem end thereof is a retracted position; in this case the opposite end of each stem element or member adjacent the sliding member may be configured to cooperate with the adjacent pan of the sliding member so as to provide a camming action whereby longitudinal displacement of the sliding member urges the stem elements or members outwards into the expanded position.

An alternate method for placing the ring cores on the winding shaft comprises providing a splitable two part clam shell type mold wherein each half mold has a longitudinal groove configured to seat one half of a core. The two halls are disposed together so as to define a channel configured to accept a plurality of cores stacked one on top of the other; i.e. the channel is disposed vertically and cores are added thereto to form a stack. Thereafter the winding shaft is placed into the mold with the cores surrounding it in sleeve like fashion. At this point the mold is placed horizontally and on haft of the mold is removed to expose the shaft with the cores surrounding it; the cores are thereafter distributed above the appropriate openings prior to being locked into position.

I claim:

1. A winding shaft for winding an elongated member about a ring drum core, said shaft being configured for releasably engaging said ring drum core, said ring drum core having an inner diameter, said winding shaft comprising a hollow outer casing member, and expansion clamp means for releasably engaging said ring dream core, said outer casing member provided with an opening, said outer casing member having an outer diameter smaller than the inner diameter of said ring drum core, said expansion clamp means comprising a deformable stem member projecting from a support member, said support member being disposed within said outer casing member and being displaceable between an operative and a non-operative position, and means for displacing the support member between said operative and non-operative positions, said stem member and said opening being sized and configured such that when said ring drum core is disposed about the outer casing member over said opening and said support member is in an operative position, the stem member is in an extended configuration wherein an end part of the stem member extends out of said opening such that the stem member engages the ring drum core such that rotation of the shaft rotates the ring drum core for winding an elongated member about said ring drum core and when said ring drum core is disposed about the outer casing member over said opening and said support is in a non-operative position, the stem member is deformed such that the stem member is in a retracted configuration wherein said end part of the stem member is retracted relative to said opening such that the shaft has an outer diameter smaller than the inner diameter of the ring drum core and the ring drum core is removable from shaft.

2. A shaft as defined in claim 1 including lock means for releasably locking the support member in said operative position.

3. A shaft as defined in claim 1 for releasably engaging a plurality of said ring drum cores wherein said outer casing member is provided with a plurality of pairs of opposed openings, said pairs of openings being axially spaced apart from each other, and wherein said expansion clamp means comprises a plurality of pairs of opposed stem members, said pairs of stem members being axially spaced apart from each other, each pair of stem members and a respective pair of said openings being sized and configured such that when a respective ring drum core is disposed about the outer casing member over said respective pair of openings and the support member is in said operative position, each stem member of said pair of stem members is in an extended configuration wherein an end part thereof extends out of a said respective opening such that each stem member of said pair of stem members engages said respective ring drum core such that rotation of the shaft rotates said respective ring drum core for winding an elongated member about said ring drum core, and when said respective ring drum core is disposed about the outer casing member over said respective pair of openings and the support means is in a non-operative position, each stem member of said pair of stem members is in a retracted configuration wherein said end part of said stem member is retracted relative to said respective opening such that the shaft has an outer diameter smaller than the inner diameter of the ring drum core and the ring drum core is removable from the shaft.

4. A shaft as defined in claim 1 wherein said outer casing member has an interior wall and said support member is sized and configured to engage the interior wall of the outer casing member for sliding displacement of the support member between said operative and non-operative positions.

5. A winding shaft for winding an elongated member about a ring drum core, said shaft being configured for releasably engaging said ring drum core, said ring drum core having an inner diameter, said winding shaft comprising a hollow outer casing member clamp means having an expanded configuration and a contracted configuration, and means for urging the clamp means between said expanded and contracted configurations, said clamp means being configured such that when the clamp means is in an expanded configuration and a ring drum core is disposed about the shaft, the clamp means engages the ring drum core such that rotation of the shaft rotates the ring drum core for winding an elongated member about said ring drum core and when the clamp means is in a contracted configuration and a ring drum core is disposed about the shaft, the shaft has a diameter smaller than the inner diameter of the ring drum core and the ring drum core is removable from the shaft said outer casing member having an interior wall and said support member being sized and configured to engage the interior wall of the outer casing member for sliding displacement of the support member between said operative and non-operative positions.

6. A shaft as defined in claim 5 including lock means for releasably locking the support member in said operative positions.

7. A winding shaft able to releasably engage a plurality of ring drum cores such that an elongated member may be wound about each of said ring drum cores, each of said ring drum cores having an inner diameter, said winding shaft comprising a hollow outer casing member, and expansion clamp means for releasably engaging said ring drum cores, said hollow outer casing member having an outer diameter smaller than the inner diameter of said ring drum cores, said hollow outer casing member being provided with a plurality of pairs of opposed openings, said pairs of openings being axially spaced apart from each other, said expansion clamp comprising a plurality of pairs of opposed stem members projecting from a support member, said pairs of stem members being axially spaced apart from each other, said support member being disposed within said hollow casing member and being displaceable between an operative and a non-operative position, and means for displacing the support between said operative and non-operative positions, said hollow outer casing having an interior wall, said support member being sized and configured to engage the interior wall of the hollow outer casing member for sliding displacement of the support member between said operative and non-operative positions, each pair of stem members and a respective pair of said openings being sized and configured such that when a respective ring drum core is disposed about the outer casing member over said respective pair of openings and the support member is in said operative position, each stem member of said pair of stem members is in an extended configuration wherein an end part thereof extends out of a said respective opening such that each stem member of said pair of stem members engages said respective ring drum core such that rotation of the shaft rotates said respective ring drum core for winding an elongated member about said rang drum core, and when said respective ring drum core is disposed about the outer casing member over said respective openings and the support means is in a non-operative position, each stem member of said pair of stem members is in a retracted configuration wherein said end part of said member is retracted relative to said respective opening such that the shaft has on outer diameter smaller than the inner diameter of the ring drum core and the ring drum core is removable from the shaft, said winding shaft including lock means for releasably locking the support member in said operative position.

* * * * *